US006127907A

United States Patent [19]

Furuya et al.

[11] Patent Number: 6,127,907

[45] Date of Patent: Oct. 3, 2000

[54] HIGH FREQUENCY FILTER AND FREQUENCY CHARACTERISTICS REGULATION METHOD THEREFOR

[75] Inventors: Mitsuru Furuya; Osamu Myohga; Yoshitsugu Okada, all of Tokyo, Japan

[73] Assignee: NEC Corporation, Tokyo, Japan

[21] Appl. No.: 09/187,873

[22] Filed: Nov. 6, 1998

[30] Foreign Application Priority Data

| | | | |
|---|---|---|---|
| Nov. 7, 1997 | [JP] | Japan | 9-306014 |
| Jun. 9, 1998 | [JP] | Japan | 10-161142 |
| Jun. 17, 1998 | [JP] | Japan | 10-169068 |

[51] Int. Cl.[7] ..... H01P 7/00

[52] U.S. Cl. ..... 333/235; 333/219.1; 257/528

[58] Field of Search ..... 333/219, 219.1, 333/219.2, 227, 231, 235; 251/528, 531

[56] References Cited

U.S. PATENT DOCUMENTS

| | | | |
|---|---|---|---|
| 4,620,169 | 10/1986 | Blickstein . | |
| 5,448,211 | 9/1995 | Mariani . | |
| 6,016,090 | 1/2000 | Lio et al. | 333/219.1 |
| 6,016,434 | 1/2000 | Mizuno et al. | 333/235 |

FOREIGN PATENT DOCUMENTS

| | | |
|---|---|---|
| 55-044232 | 3/1980 | European Pat. Off. . |
| 62-144417 | 6/1987 | European Pat. Off. . |
| 03212009 | 9/1991 | European Pat. Off. . |
| 29 41 826 | 10/1979 | Germany . |
| 55-117310 | 9/1980 | Japan . |
| 59-194504 | 11/1984 | Japan . |
| 61-288486 | 12/1986 | Japan . |
| 62-76301 | 4/1987 | Japan . |
| 63-113303 | 7/1988 | Japan . |
| 3-212009 | 9/1991 | Japan . |
| 537202 | 2/1993 | Japan . |
| 6-334413 | 12/1994 | Japan . |
| 7-58505 | 3/1995 | Japan . |
| 9-246820 | 9/1997 | Japan . |

OTHER PUBLICATIONS

Conference Proceedings of the 23rd European Microwave Conference, Palacio de Congresos, Madrid, Spain, pp. 581–584, Sep. 6–9, 1993.

*Primary Examiner*—David Hardy
*Attorney, Agent, or Firm*—Hutchins, Wheeler & Dittmar

[57] ABSTRACT

Dielectric parts 12 which become resonators are fitted in holes formed in a dielectric substrate 11 and magnetic parts 13 for setting resonance frequencies of the dielectric parts 12 are also fitted in holes formed in the dielectric substrate 11. With such construction in which the dielectric parts are fitted in the holes of the dielectric substrate, the physical preciseness of a high frequency filter is improved. Further, by fitting not only the dielectric parts 12 but also the magnetic parts 13 in the holes of the dielectric substrate 11, it is possible to form the high frequency filter operating in a frequency band of several tens GHz as a micro wave integrated circuit to thereby improve the uniformality and mass-producibility of the high frequency filter.

15 Claims, 7 Drawing Sheets

HIGH FREQUENCY FILTER AND FREQUENCY CHARACTERISTICS REGULATION METHOD THEREFOR

BACKGROUND OF THE INVENTION

The present invention claims priorities from Japanese Patent Applications No. 9-306014 filed Sep. 7, 1997, No. 10-161142 filed Jun. 17, 1998 and No. 10-169068 filed Jun. 17, 1998, which are incorporated herein by reference.

1. Field of the Invention

The present invention relates to a high frequency filter formed in a high frequency integrated circuit or a micro wave integrated circuit (MIC) formed by mounting or forming a plurality of circuit elements on a substrate. The present invention can be utilized in a communication equipment, a radar equipment, a measurement device, etc. Although the present invention was developed for the purpose of utilization in a high frequency circuit having an operating frequency exceeding 10 GHz, the operating frequency is not limited thereto and the present filter can be used in a circuit having an operating frequency lower than 10 GHz.

2. Description of Related Art

A micro wave integrated circuit (MIC) having a dielectric resonator mounted on a dielectric substrate of such as ceramics has been known. For example, Japanese Patent Application Laid-open No. Hei 6-334413 discloses a construction of such micro wave integrated circuit in which an insulating film is formed on a surface of a semiconductor substrate, a conductor line is formed on the insulating film and a dielectric resonator is mounted in the vicinity of the conductor line by as adhesive.

Japanese Patent Application Laid-open No. Sho 61-288486 discloses a technique by which a hole formed in an alumina substrate before baking is filled with ferrite and the ferrite is fixed to the hole of the substrate by burning. This technique is useful in mounting the ferrite on the ceramic substrate. Although the present invention belongs to this technique, this prior art technique is merely to mount the ferrite unit on the alumina substrate and include neither a technical thought that a plurality of mutually related circuit parts on an alumina substrate to unify them as an integrated circuit nor a technical thought of mounting dielectric parts on the same substrate. Further, the prior art technique does not include a technical thought of use of hard ferrite as the ferrite and magnetization of the hard ferrite correspondingly to an electrical characteristics of the circuit.

On the other hand, a high frequency band exceeding 10 GHz have been used in various devices recently. Particularly, a technique for mass-producing inexpensive high frequency filters which have uniform characteristics and can be stably utilized in a 60 GHz band or a 70 GHz band assigned to a radar device for automobile or a distance measuring device has been required. Further, with an improvement of the ferrite technology, a low loss hard ferrite whose anisotropic magnetic field can be regulated and which has high coercive force has become usable.

Such technique for mounting a dielectric resonator in the vicinity of the conductor line is basically superior technique. However, since such technique utilizes the adhesive, the number of manufacturing steps for producing such high frequency filters is increased and the characteristics thereof tend to vary, causing the prior art technique to be not always suitable for mass-production. Further, in a case where a filter circuit and an antenna circuit for use in such frequency band as high as several tens GHz are designed, circuit parts to be mounted on a circuit substrate, for example, a dielectric part in the form of a circular rod, may have a diameter in the order of 2 to 3 mm and magnetic parts may become smaller than the dielectric part. In order to correctly adhere parts having such size to the substrate, a machining preciseness of the parts as high as several tens microns is required. In order to achieve such high machining preciseness, a high precision machine tool is necessary, so that a considerable investment is required in mass-producing such circuits.

It has been found experimentally that the technique for mounting ferrite on an alumina substrate before baking thereof is very effective for ferrite parts having diameter of 2 mm. However, it is impossible to design a desired filter circuit or an antenna circuit operable in the frequency band of several tens GHz with using such ferrite part unit as disclosed in Japanese Patent Application Laid-open No. Sho 61-288486. If a plurality of such parts are arranged on a single substrate and connected each other to form a circuit, a large number of working steps are required and the loss due to the connections and the reliability of connecting points, etc., become problems. Therefore, it is necessary to provide an integrated circuit by integrally incorporating micro strip lines using conductors having similar size to that of the ferrite unit and dielectric parts on one and same substrate.

When a high frequency filter to be used in the frequency band of several tens GHz by using a micro wave integrated circuit, the size of the substrate becomes very small. In an example, the size is 8 mm×3 mm×0.3 mm. In such small size circuit, the electric characteristics thereof is substantially influenced by even minute size error of the part and it is indispensable to regulate the frequency characteristics thereof after manufacture thereof. In the prior art technique, such regulation depends largely upon experience and is not suitable to manufacture uniform products. Further, the reproducibility thereof is not enough. In addition, when the regulation is performed by mechanically cutting the magnetic part, the regulation can be made only unidirectional. Since, when the part is over cut, it is impossible to recover the over-cut portion, the yield becomes low.

SUMMARY OF THE INVENTION

An object of the invention is to provide a high frequency filter which can be manufactured with high precision, has a stable electric characteristics and can be regulated easily.

The high frequency filter according to the present invention is featured by comprising a dielectric substrate having a surface on which a conductor line is formed, the dielectric substrate being formed with a plurality of holes, a dielectric part functioning as a resonator fitted in each of a certain number of said holes and a magnetic part fitted in each of at least a certain holes of the remaining holes, for setting a resonance frequency of the corresponding dielectric part by a magnetic field generated thereby.

The high frequency filter of the present invention can be manufactured with higher machining precision compared with the conventional structure in which individual parts are arranged on substrates and the latter are connected each other and exhibits a uniform and stable high frequency characteristics. Further, the number of manufacturing steps of the present high frequency filter is smaller and the manufacturing cost thereof can be reduced by mass production.

Plastic material, particularly, polytetrafluoroethylene, can be used as a material of the dielectric substrate. Alternatively, ceramic may be used therefor. When plastics such as polytetrafluoroethylene is used, it is preferable to provide a reinforcing plate for preventing a mechanical deformation on a read surface of the substrate.

In order to facilitate the frequency regulation, hard ferrite is preferably used as a material of magnetic parts.

In order to regulate the frequency characteristics of the present high frequency filter, the magnetic parts may be mounted on the substrate detachably.

The dielectric parts may be fitted in the respective holes formed in one of main surfaces of the dielectric substrate and the magnetic parts may be fitted in respective holes formed in the other surface thereof. In the latter case, in order to put the dielectric part in a magnetic field generated by the corresponding magnetic part, the magnetic parts and the dielectric parts should be arranged in mutually corresponding positions, respectively. Further, it is preferable to arrange the dielectric parts such that they are magnetically coupled with each other.

In order to obtain a high Q value, it is possible to form a cavity between a lower surface of the dielectric part and the dielectric substrate. For the same purpose, it is also possible to bury the dielectric part in the dielectric substrate through a material having dielectric constant lower than that of the dielectric substrate. In the latter case, the dielectric substrate may be of ceramic, particularly, low temperature sintered glass ceramic. The low dielectric constant material disposed between the lower surface of the dielectric part and the dielectric substrate is preferably plastic, particularly, polytetrafluoroethylene.

The structure in which the cavity is formed between the lower surface of the dielectric part and the dielectric substrate and the structure in which the dielectric part is buried in the dielectric substrate through the lower dielectric constant material can be utilized in a high frequency filter having no magnetic part provided.

When hard ferrite is used as the magnetic part, the frequency characteristics of the high frequency filter of the present invention is regulated by externally applying a magnetic field to the magnetic part to change the state of magnetization thereof. That is, the magnetic part is heated to a temperature higher than Curie temperature of the magnetic material to demagnetize the magnetic part and then magnetize it by applying a magnetic field thereto while cooling it. The change of magnetization of the magnetic part should be performed while monitoring the frequency characteristics of the high frequency filter.

As another method of regulating the frequency characteristics of the high frequency filter, it is possible to mechanically remove a portion of the magnetic part. In such case, it is preferable to preliminarily set a height of the magnetic part such that it protrudes from the surface of the dielectric substrate so that the protruded portion of the magnetic part can be removed.

A further method for regulating the frequency characteristics of the high frequency filter, it is possible to prepare a plurality of magnetic parts the sizes of which are identical and the magnetic field strengths of which are mutually different and to select one of them with which an optimal frequency characteristics can be obtained, by changing the magnetic part one by one while measuring the frequency characteristics of the high frequency filter.

A manufacturing method for manufacturing the above described high frequency filter will be described.

In the case where a ceramic substrate is used as the dielectric substrate, the ceramic substrate is prepared by forming a plurality of holes in a green ceramic sheet thereof before sintering by punching, fitting circuit parts in these holes and, then, sintering the green sheet having the circuit parts at a temperature lower than a temperature at which the circuit parts are deformed and not lower than the sintering temperature of the green sheet. In this case, the circuit parts are fixed to the ceramic substrate by utilizing the shrinking nature of the green sheet during the sintering process. Thus, it is possible to unify the magnetic parts and the dielectric parts ceramic to the ceramic substrate.

In the case where hard ferrite is used as the magnetic part, it is preferable that the sintering temperature of a green sheet thereof is set not higher than a temperature at which hard ferrite is sintered and, when the temperature of hard ferrite becomes in the vicinity of Curie temperature thereof or lower than Curie temperature thereof after the ceramic substrate is sintered, the hard ferrite is magnetized by applying a magnetic field thereto. The sintering temperature of the ceramic substrate is 800~1200° C. The Curie temperature of hard ferrite is within about 400~700° C. depending upon the kind of material. Further, the magnetization of the hard ferrite is regulated by regulating the magnetic field applied thereto. It is preferable to perform the regulation of magnetization while monitoring the electric characteristics of the integrated circuit.

Since the respective circuit parts are fitted in the holes of the ceramic substrate, it is possible to set a mutual positional relation between the circuit parts easily and precisely, provided that the holes are positioned exactly in the substrate.

Since there is the shrinkage of the substrate due to sintering, the mutual positional relation between the circuit parts is regulated such that the configuration of the ceramic substrate after sintered becomes a desired one by preparing a plurality of samples. Once the regulation is completed, it becomes possible to manufacture a number of identical integrated circuits without individual regulations of them.

The size of the holes formed in the green sheet is also regulated by preparing a plurality of samples such that the magnetic parts and the dielectric parts are suitably secured thereto after the green sheet is sintered. Once the regulation is completed, it becomes possible to uniformly manufacture a number of identical integrated circuits without individual regulations of them.

The height of the circuit part measured from the surface of the ceramic substrate is preferably the same as the thickness of the substrate or more. When the circuit part is the dielectric part, it can be machined even when its height is larger than the thickness of the substrate, in which case, the freedom of the configuration of the part becomes larger, allowing a variety of circuits to be designed.

The shape of the hole formed in the green sheet is most preferably circular and at least a portion of the circuit part which becomes in contact with the hole is cylindrical, since the shrinking force of the hole against the portion becomes uniform. Although it is possible to make an outer configuration of the circuit part ellipsoidal in cross section, the number of tests for optimally securing the part to the substrate may be increased.

The sintering temperature of the green sheet should be selected such that the properties on the magnetic part, particularly, hard ferrite, are not changed at that temperature. It has been found as a result of tests, however, that, even when the green sheet is sintered at a temperature not higher than the Curie temperature of the hard ferrite, the desired characteristics of the high frequency filter can be obtained by reducing the temperature after the sintering completes and ordering the magnetic orientation again by applying a magnetic field to the hard ferrite when it becomes lower than the Curie temperature of the ferrite. Since the sintering temperature and the Curie temperature of the hard ferrite depends upon the kind of hard ferrite, the sintering temperature and the temperature at which the magnetization is performed are selected correspondingly to the properties of the green sheet and the hard ferrite, respectively. The sintering temperature is not always set to a temperature not lower than the Curie temperature of the hard ferrite.

In magnetizing the magnetic part after completion of the sintering, it may be performed after the sample becomes room temperature. However, the magnetic part can be easily magnetized to a desired value while lowering its temperature from a relatively high temperature. Further, it is possible to change the magnetized state of the magnetic part by electrically operating a high frequency circuit after the magnetization is performed, while measuring the characteristics of the high frequency circuit.

The case where the magnetic parts are preliminarily fixed to the dielectric substrate has been described. However, in order to make the magnetic parts detachable with respect to the dielectric substrate, the magnetic parts may be fitted in the holes of the sintered substrate. In such case, holes are formed in both surfaces of the green sheet, the dielectric parts are fitted in the holes formed in one surface of the green sheet and the green sheet is sintered. After or before conductor lines are formed on the one surface of the sintered green sheet, that is, the dielectric substrate, the magnetic parts are fitted in the holes formed in the other surface of the dielectric substrate.

By making the magnetic parts detachable with respect to the dielectric substrate and changing them, it is possible to regulate the frequency characteristics thereof. That is, by repeating the monitoring of the frequency characteristics of an output derived from the conductor lines formed on the high frequency filter and the replacement of the respective magnetic parts by other magnetic parts having different magnetic field strengths, the magnetic parts which can realize a desired frequency characteristics of the filter can be selected.

Although it is preferable to form the holes in the green sheet, it may be possible to form the holes in the dielectric substrate after sintering.

When a plastic is used as the material of the dielectric substrate or when the circuit parts are fitted after sintering, it is preferable to use an adhesive.

When ceramic is used as the material of the dielectric substrate and cavities are formed between the dielectric substrate and lower surfaces of the dielectric parts, it may be possible to form holes having a first diameter in a predetermined number of green sheets of a plurality of green sheets, to form holes having a second diameter smaller than the first diameter in another predetermined number of green sheets, to laminate these green sheets such that each of the holes having the first diameter and formed in one green sheet and each of the holes having the second diameter and formed in a next green sheet form a stepped hole, to fit the dielectric parts having cylindrical portions in the holes having the first diameter of the laminated green sheets, and to fix the dielectric parts to the holes having the first diameter of the laminated green sheets by sintering the laminated green sheets.

BRIEF DESCRIPTION OF THE DRAWINGS

This above mentioned and other objects, features and advantages of the present invention will become more apparent by reference to the following detailed description of the invention taken in conjunction with the accompanying drawings, in which.

DETAILED DESCRIPTION OF THE PREFERRED EMBODIMENTS

Figure 1:
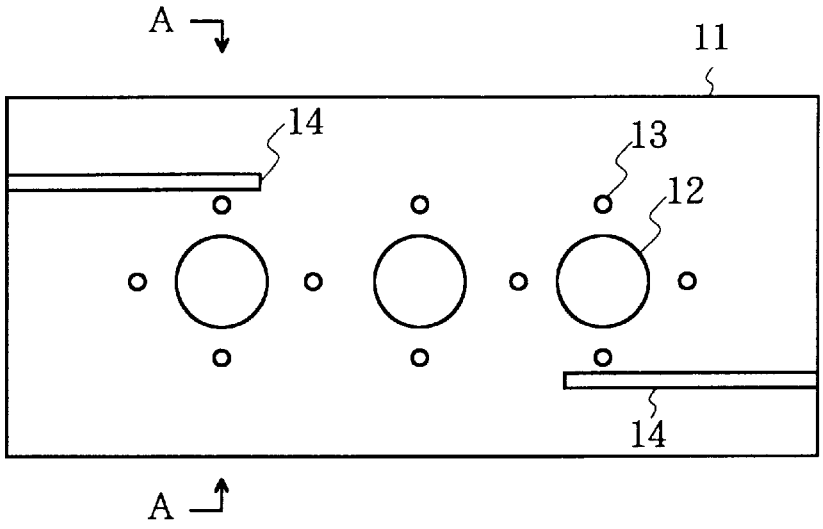
FIG. 1 is a plan view of a high frequency filter according to a first embodiment of the present invention.
Figure 2:
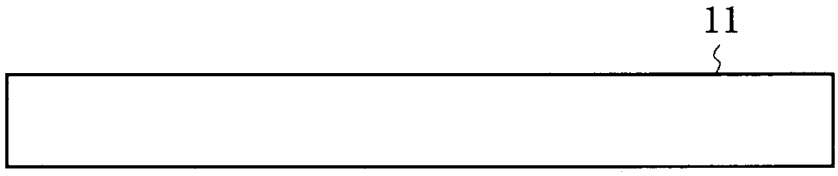
FIG. 2 is a front view of the high frequency filter shown in FIG. 1.
Figure 3:
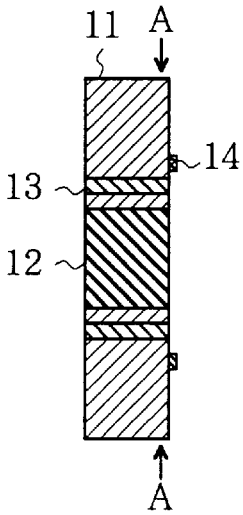
FIG. 3 is a cross section taken along a line A—A in FIG. 1.

FIGS. 1 to 3 show a high frequency filter according to a first embodiment of the present invention, in which FIG. 1 is a plan view of the first embodiment, FIG. 2 is a front view thereof and FIG. 3 is a cross section taken along a line A—A in FIG. 1. The size of a dielectric substrate 11 of this embodiment is about 10×4×0.3 mm and is formed on, for example, ceramic. The dielectric substrate 11 is formed with three holes having a certain diameter and 10 holes having a diameter which is smaller than the certain diameter. Dielectric parts 12 are fitted in the large holes and magnetic parts 13 are fitted in the small holes, respectively. Micro strip lines 14 are formed on a surface of the dielectric substrate 11 by printing the surface with electrically conductive material.

Describing the manufacturing steps of the high frequency filter according to the first embodiment in a case where a ceramic substrate is used as the dielectric substrate 11, a green sheet of the ceramic substrate before sintering is formed with a plurality of holes by punching. Dielectric parts 12 and magnetic parts 13 which are in the form of a circular pillars are fitted in these holes, respectively. The magnetic parts 13 are of hard ferrite. In this manner, the circuit parts are fitted in the green sheet of the ceramic substrate and, then, the substrate is sintered. The sintering temperature is lower than a sintering temperature of the hard ferrite. The micro strip lines 14 are formed by printing the surface of the ceramic substrate 11 with gold paste with using a printing mask and baking it. The ceramic substrate 11 is cooled in air after the sintering and, when a surface temperature thereof becomes about 600° C., the magnetic parts 13 fitted in the ceramic substrate 11 are magnetized by applying a magnetic field thereto while the cooling is continued.

Relative dielectric constant $\epsilon_r$, of the ceramic substrate is about 7. The dielectric parts 12 are of Ba group ceramic and have relative dielectric constant which is about 24.

The magnetization of the magnetic parts 13 is performed individually by applying a magnetic field to each of them while measuring the frequency characteristics (frequency-loss characteristics) of the high frequency filter such that the characteristics curve thereof becomes closer to the design value.

Figure 4:
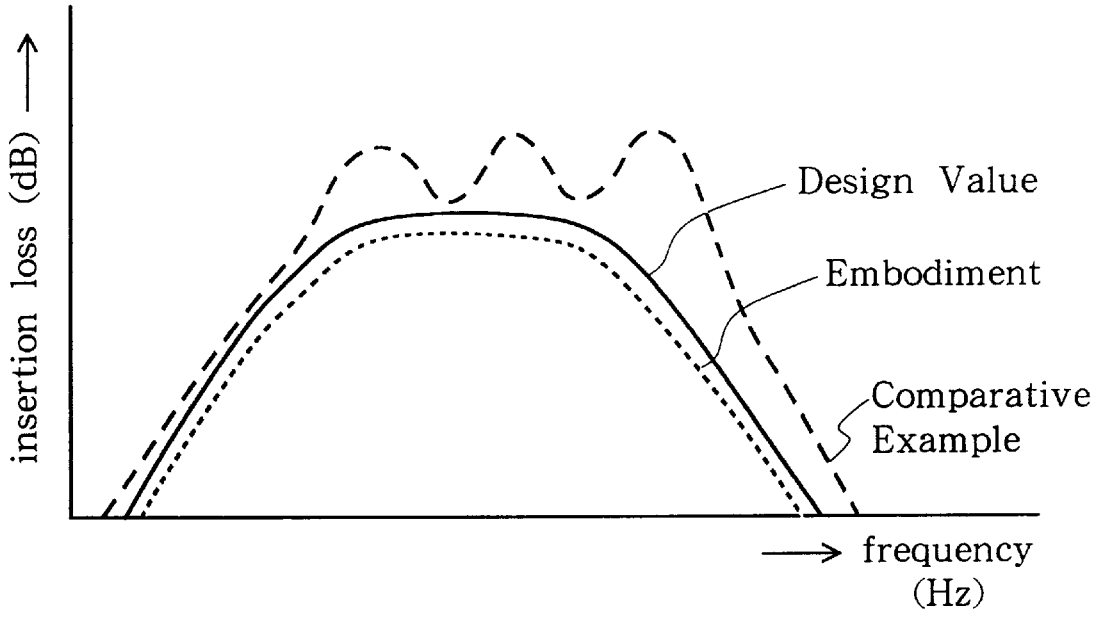
FIG. 4 is a graph showing a frequency characteristics of the high frequency filter shown in FIG. 1.

FIG. 4 shows the frequency characteristics of the high frequency filter according to this embodiment. In FIG. 4, a solid curve shows the design frequency characteristics of this high frequency filter, a dotted curve shows a final frequency characteristics of the high frequency filter of this embodiment and a chained curve shows a comparative example of a final frequency characteristics of a high frequency filter in which the dielectric parts 12 and the magnetic parts 13 are arranged on the ceramic substrate by using a manipulator and fixed thereto be adhesive, according to the conventional method.

Next, the case where the dielectric substrate 11 is of an organic material. In this case, diameter of each of the holes formed in the substrate is larger than the diameter of the circuit part to be fitted therein by 0.05 to 0.1 mm. On inner walls of the holes, an adhesive is provided by painting and the dielectric parts and the magnetic parts are inserted thereinto and adhered thereto. Thereafter, metal conductors are formed on one of the surfaces of the substrate by plating such that there is a desired relation established between the magnetic parts and the dielectric parts. On the other surface of the substrate, a metal film is formed entirely.

In another manufacturing method of the high frequency filter having the dielectric substrate 11 of an organic material, the magnetic parts are adhered onto a metal foil by electrically conductive adhesive and the dielectric parts are adhered onto the metal foil by an electrically conductive adhesive or an electrically insulating adhesive. On the surface of the metal foil on which the dielectric parts and the dielectric parts are adhered, organic resin is painted to a thickness substantially the same as the height of the circuit parts and hardened. Thereafter, a metal conductor is formed on the organic resin layer by plating such that a desired positional relation is obtained between the magnetic parts and the dielectric parts.

In a further manufacturing method of the high frequency filter having the dielectric substrate 11 of an organic material, diameter of each of the holes formed in the substrate is larger than the diameter of the circuit part to be fitted therein by 0.05 to 0.1 mm. The magnetic parts are adhered onto a metal foil by electrically conductive adhesive and the dielectric parts are adhered onto the metal foil by an electrically conductive adhesive or an electrically insulating adhesive. The circuit parts adhered to the surface of the metal foil are inserted into the holes of the substrate and, then, the metal foil is adhered onto one of the surfaces of the substrate. Thereafter, a metal conductor is formed on the other surface of the substrate by plating such that the metal conductor becomes a desired positional relation to the respective circuit arts.

By forming the holes in the substrate, it is possible to integrate the dielectric parts and the magnetic parts on the single substrate with high physical precision. Therefore, it is possible to mass-produce high frequency filters having uniform characteristics in the frequency band of several tens GHz. Further, since, according to the present invention, the frequency characteristics of the high frequency filter can be regulated after manufacture thereof by utilizing the hard ferrite and regulating the magnetization thereof and since the regulation can be performed reversibly, the yield of products is improved and a high precision regulation can be performed.

Figure 5:
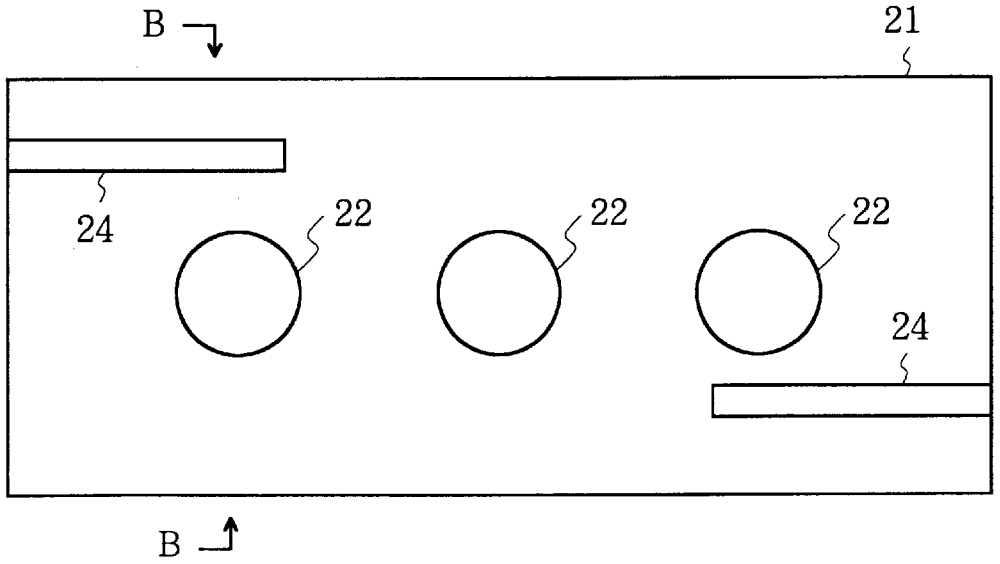
FIG. 5 is a plan view of a high frequency filter according to a second embodiment of the present invention.
Figure 6:
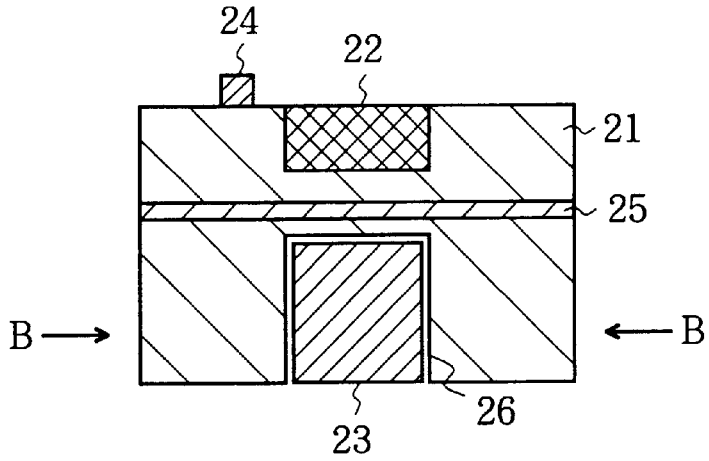
FIG. 6 is a cross section taken along a line B—B in FIG. 5.

FIGS. 5 and 6 show a second embodiment of the present invention, in which FIG. 5 is a plan view of the second embodiment and FIG. 6 is a cross section taken along a line B—B in FIG. 5. Referring to FIGS. 5 and 6 three dielectric parts 22 are juxtaposed on an upper surface of a dielectric substrate 21. In this case, three holes are also formed in a lower side surface of the dielectric substrate 21 such that center axes of the holes in the upper surface coincide with center axes of the holes in the lower surface, respectively, and the dielectric parts 22 are fitted in the holes in the upper surface of the dielectric substrate 21, respectively. An upper and lower surface of each dielectric part 22 are coplanar with the surfaces of the dielectric substrate 21. On the other hand, the magnetic parts 23 are fitted in the holes 26 in the lower surface of the dielectric substrate 21.

Micro strip lines 24 are formed on the surface of the dielectric substrate 21 correspondingly to the dielectric parts 22 positioned at both ends. A ground pattern layer 25 for the micro strip lines is provided within the dielectric substrate 21. That is, the dielectric parts 22 and the micro strip lines 24 are provided in the upper surface of the dielectric substrate 21 and the magnetic parts 23 are provided in the lower surface thereof correspondingly in position to the dielectric parts 22 with the ground pattern layer 25 being interposition. The magnetic parts fitted in the holes 26 in the lower surface of the substrate may be of either hard ferrite or rare-earth magnet.

Size of the dielectric substrate 21 is about 10 mm×4 mm×2 t where t is the thickness of the conventional substrate and the dielectric substrate is formed of a lower temperature sintered glass ceramic. The lower temperature sintered glass ceramic is a composite of borosilicate glass and alumina ($Al_2O_3$). However, it may be a composite of borosilicate lead glass. Borosilicate glass contains, in reduced oxide, 40~70 wt % Si, 8~30 wt % B, 5~20 wt % Ca and 2 wt % or less of Na, K, Mg, Ba, etc., as impurities. Borosilicate lead glass contains, in reduced oxide, 40~70 wt % Si, 5~20 wt % B, 5~20 wt % Pb and 2 wt % or less of Na, K, Mg, Ba, etc., as impurities.

The manufacturing of the high frequency filter according to the second embodiment will be described in detail. In this embodiment, a multi-layered low temperature sintered glass ceramic prepared by laminating a plurality of green sheets of glass ceramic and sintering them at one time is used. First, a predetermined number of the green sheets which are to be on an upper surface side and a predetermined number of the green sheets which are to be on a lower surface side are formed with holes by punching, respectively. Then, the green sheets having the holes are laminated Dielectric parts 22 machined to circular configurations are fitted in the holes of the green sheets on the upper surface side. Dielectric constant of the dielectric part 22 is higher than that of the dielectric substrate 21. After the dielectric parts 22 are fitted, the laminated green sheets are sintered simultaneously.

By this sintering, the low temperature sintered glass ceramic substrate shrinks, so that the dielectric parts 22 are fixedly secured as if they are buried in the substrate. The sintering temperature is lower than a sintering temperature of the dielectric parts 22 so that the dielectric parts 22 are not influenced by the sintering of the substrate. In this embodiment, the sintering temperature of the dielectric part is in the order of 1600° C. and the sintering temperature of the low temperature sintered glass ceramic substrate is in the order of 900° C.

After the sintering, predetermined areas of the substrate surface are printed with gold paste with using a printing mask. Then, the micro strip lines 24 are formed by baking.

Then, the magnetic parts 23 are fitted in the holes 26 formed in the lower surface of the high frequency filter, such that resonance frequencies of the dielectric parts 22 are influenced by magnetic fields generated by the magnetic parts 23.

Figure 7:
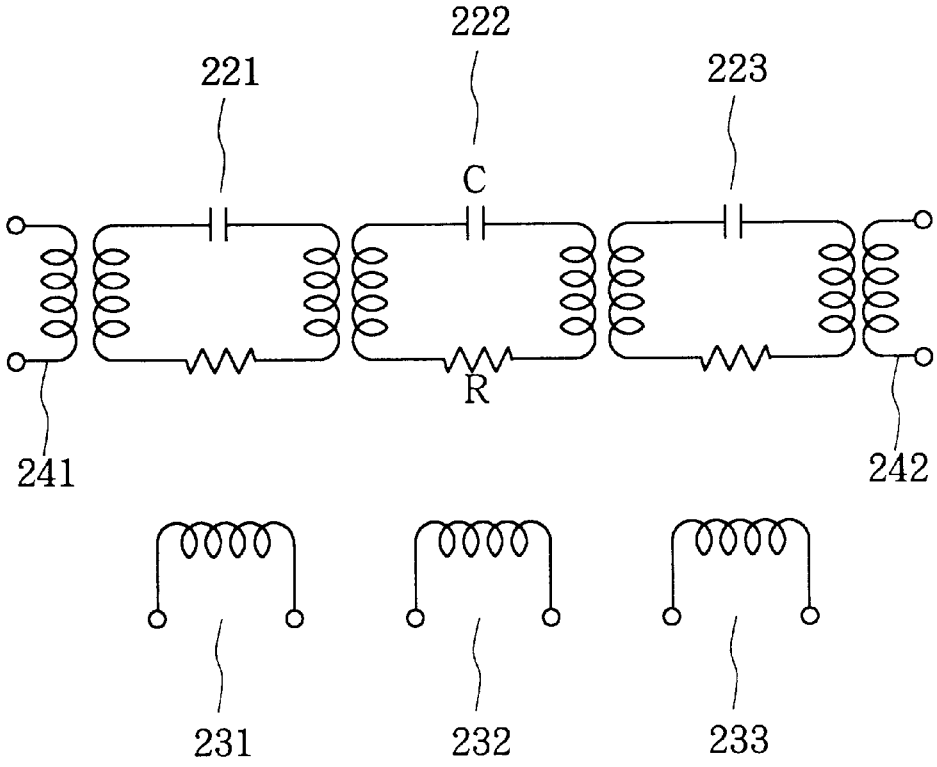
FIG. 7 is an equivalent circuit of the high frequency filter shown in FIG. 5.

FIG. 7 is an equivalent circuit of the high frequency filter shown in FIGS. 5 and 6. In this circuit, the dielectric parts 22 are equivalently represented by LCR circuits 221~223 each composed of a winding L, a capacitor C and a resister R. Further, the micro strip lines 24 can be represented equivalently by inductances 241 and 242, respectively. The LCR circuits 221~223 are mutually coupled magnetically and the LCR circuits 221 and 223 located at the both ends are magnetically coupled with windings 231 and 232 which are the equivalent circuits of the micro strip lines 24, respectively.

Representing an inductance of the winding L by L and a capacitance of the capacitor C by C, the resonance frequency $f_0$ of the LCR circuit can be represented by $f_0=1/\{2\pi(LC)^{1/2}\}$.

Windings 231~233 which are equivalent circuits of the magnetic parts 23 are also magnetically coupled with the corresponding LCR circuits 221~223, respectively. Therefore, it is possible to change the resonance frequencies and hence the characteristics of the high frequency filter by changing inductances of these windings. Consequently, it is possible to realize a filter having a desired frequency characteristics by preparing a plurality of magnetic parts having different magnetic strengths and selectively fitting them in the holes 26 in the lower surface of the substrate while monitoring the frequency characteristics of the filter.

Figure 8:
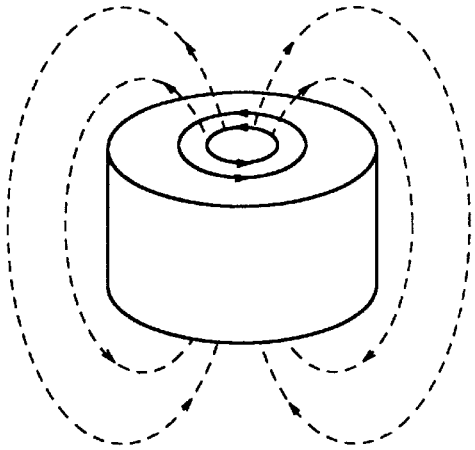
FIG. 8 illustrates an electric field and a magnetic field generated in the high frequency filter shown in FIG. 5.
Figure 9:
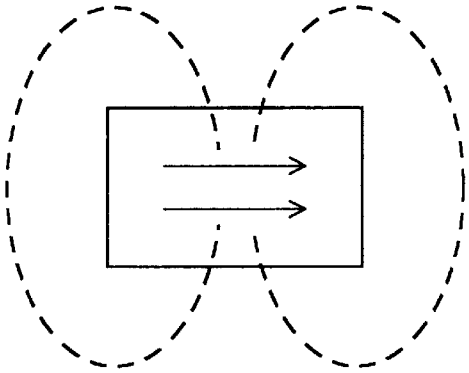
FIG. 9 illustrates the fields generated in the high frequency filter shown in FIG. 6 when looked from a side thereof.
Figure 10:
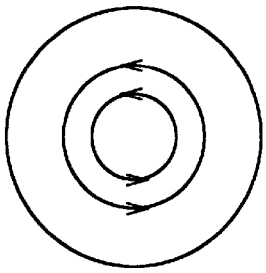
FIG. 10 illustrates the fields generated in the high frequency filter when looked down.

In such state, electric field shown in FIG. 8 by solid lines is generated according to $TE_{01\delta}$ mode which is the known basic resonance mode. Magnetic field generated by the magnetic part is shown in the same figure by dotted lines. As shown in FIG. 9 which is a cross section of the magnetic part shown in FIG. 8, the magnetic field is orthogonal to the electric field and, as shown in FIG. 10 which is a plan view of the magnetic part shown in FIG. 8, the electric field is coaxial.

Therefore, by changing the magnetic parts having different magnetic strengths while monitoring the frequency characteristics of the high frequency filter, the resonance frequency can be regulated. In more detail, after the frequency characteristics is measured by fitting magnetic parts having a certain magnetic field strength, the magnetic parts are removed and other magnetic parts having magnetic field strength different from the certain magnetic field strength are fitted in the substrate. Then, the resonance frequency of the high frequency filter is measured again and the measurement is repeated with using magnetic parts having different magnetic field strengths and the results of measurements are compared. The magnetic parts with which the most preferable measurement is obtained are selected finally and fitted in the substrate of the high frequency filter.

In this embodiment, the magnetic parts are fitted in the holes formed in not the upper surface but the lower surface of the substrate. Therefore, the distance between the magnetic parts and the micro strip lines becomes large, so that the influence of magnetic field on the micro strip lines is reduced.

Further, although, in this embodiment, the magnetic parts 23 which are the same in number as the dielectric parts and have substantially the same diameter as that of the dielectric parts 22 are fitted in the holes 26 of the substrate 21, it is possible to fit a larger number of the magnetic parts having a smaller diameter in respective areas of the lower surface of the substrate 21 which are projections of the dielectric parts. That is, a plurality of magnetic parts are provided for each dielectric part so that the dielectric part is under influence of magnetic fields generated by the magnetic parts. In the latter case, it is possible to finely regulate the frequency characteristics of the high frequency filter by detachably fitting a large number of magnetic parts in the substrate 21.

Alternatively, it is possible to constitute a filter by using one dielectric part and one magnetic part corresponding thereto. In such construction, however, it is impossible to substantially regulate the frequency characteristics of the filter since exchangeable magnetic part is only one.

Although the ceramic dielectric substrates (11, 21) have been described, it is possible to form the dielectric substrate by using a resin. The manufacture of a high frequency filter by using a resin dielectric substrate 21 will be described. The resin forming the dielectric substrate 21 may be, for example, polytetrafluoroethylene $(CF_2—CF_2)_n$. Holes having a diameter larger than a diameter of the dielectric part by 0.05~0.1 mm are formed in predetermined positions in one surface of the polytetrafluoroethylene substrate and holes having the same diameter as that of the magnetic part to be fitted therein are formed in predetermined positions in the other surface of the substrate.

Adhesive is applied to inner walls of the holes in the one surface and the dielectric parts are fitted in the holes. Thereafter, micro strip lines are formed in positions on the same surface of the substrate such that a desired positional relation is established with respect to the dielectric parts. Then, magnetic parts having optimal magnetic field strengths are fitted in the holes in the other surface of the substrate while measuring the frequency characteristics thereof similarly to the previously mentioned manner.

Other material of the dielectric substrate than polytetrafluoroethylene may be used. Teflon group material, epoxy group material such as benzocyclobutene

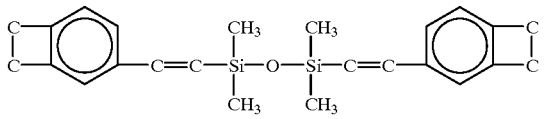

bisphenol A type epoxy resin

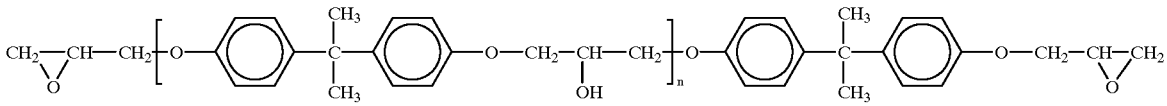

or polyimide group material such as

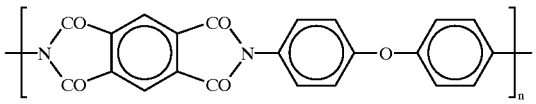

may be used therefor.

As mentioned, the present filter includes a dielectric substrate, a plurality of dielectric parts buried in one surface of the substrate and conductors formed on the one surface of the dielectric substrate. Further, a plurality of holes are formed in the other surface of the substrate and magnetic parts are detachably fitted in the holes. The dielectric substrate is preferably formed of ceramic, particularly, low temperature sintered glass ceramic. However, it is possible to form the dielectric substrate by using a resin (plastic), particularly, the above mentioned polytetrafluoroethylene.

By using the structure in which the magnetic parts are provided detachably below the dielectric parts, it is possible to regulate the frequency characteristics of the filter by changing the magnetic parts having different magnetic field strengths while monitoring a change of resonance frequency of the dielectric parts due to change of strength of magnetic field generated by the respective magnetic parts.

Comparing with the conventional structure in which the parts are arranged on a substrate and connected to each other, the machining preciseness can be improved in the structure of the present filter. Further, with the improved machining preciseness, the high frequency characteristics thereof is uniformalized and stabilized and hence it is possible to realize a reliable high frequency filter.

Although the present filter was developed for use in a high frequency circuit operating at frequency exceeding 10 GHz, it is clearly understood that the present filter can be utilized in a circuit operating in a frequency band not higher than 10 GHz.

As described hereinbefore, according to the second embodiment of the present invention, the high frequency filter is formed by unifying the substrate and the dielectric parts. Therefore, it is possible to obtain a high frequency filter having high mechanical preciseness and the frequency characteristics of the filter can be regulated reversibly by using the detachable magnetic parts.

Figure 11:
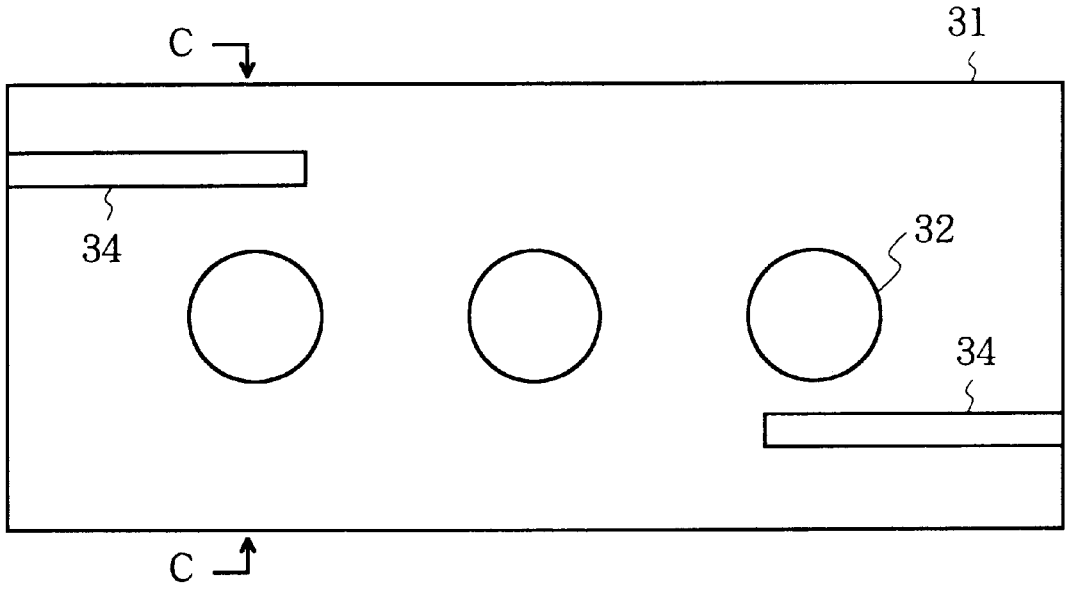
FIG. 11 is a plan view of a high frequency filter according to a third embodiment of the present invention.
Figure 12:
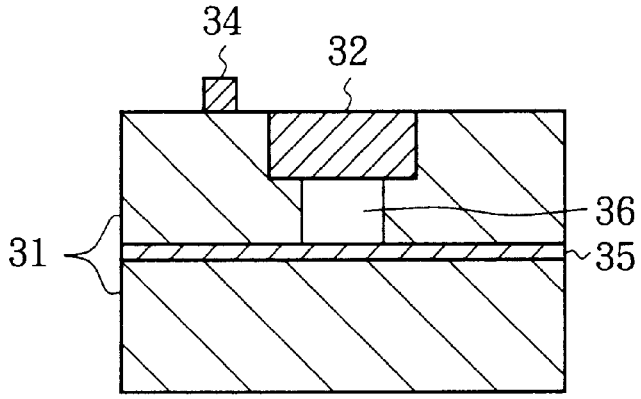
FIG. 12 is a cross section taken along a line C—C in FIG. 11.

FIGS. 11 and 12 show a high frequency filter according to a third embodiment of the present invention, in which FIG. 11 is a plan view of the high frequency filter and FIG. 12 is a cross section taken along a line C—C in FIG. 11. In this embodiment, three dielectric parts 32 are fitted in one surface of a dielectric substrate 31 and cavities 36 are formed between lower surfaces of the dielectric parts 32 and the dielectric substrate 31. Micro strip lines 34 are provided on the one surface of the dielectric substrate 31 correspondingly to the dielectric parts 32 at both ends and a ground pattern layer 35 for the micro strip lines 34 is provided within the dielectric substrate 31. The dielectric substrate 31 is formed of low temperature sintered glass ceramic. The low temperature sintered glass ceramic is a composite of borosilicate glass and alumina ($Al_2O_3$). However, it may be a composite of borosilicate lead glass. The size of the dielectric substrate is about 10 mm×4 mm×2 t where t is the thickness of the conventional substrate.

Figure 13:
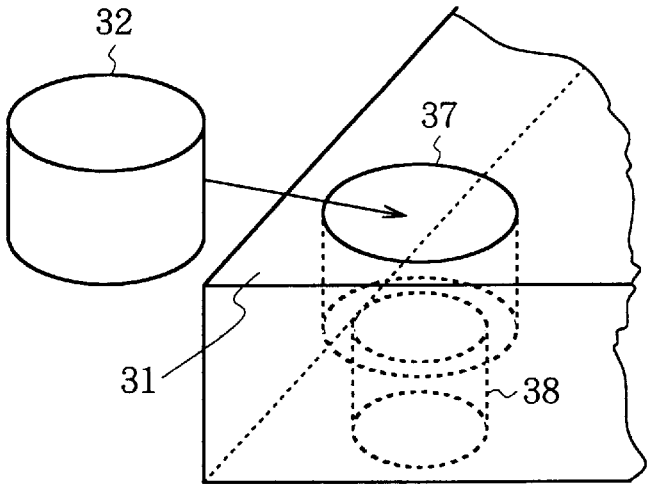
FIG. 13 illustrates a configuration of a hole formed in a dielectric substrate of the high frequency filter shown in FIG. 11.

Three holes are formed in one surface of the dielectric substrate 31. Each of the holes has a shoulder provided by reducing a diameter thereof as shown in FIG. 13. The dielectric part 32 is buried in a large diameter portion 37 of the hole and the small diameter portion 38 of the hole forms the cavity 36. Although dielectric constant of the dielectric part 32 is higher than that of the dielectric substrate 31, it is possible to increase the Q value of a resonator obtained by the dielectric part 32 since an upper and lower surfaces of the dielectric part 32 are in contact with air whose dielectric constant is lower than that of the dielectric substrate 31 and thus it is possible to obtain a high frequency filter having small insertion loss.

The manufacturing of the high frequency filter according to the this embodiment will be described in detail. A plurality of low temperature sintered glass ceramic green sheets are prepared. The ground conductor is printed on one of the green sheets and a first predetermined number of green sheets of the remaining green sheets are formed with holes 37 having a large diameter by punching and a second predetermined number of green sheets of the remaining green sheets are formed with holes 38 having a small diameter by punching. The green sheets are laminated in such order that the green sheets formed with the holes 37 having large diameter are put on the green sheets formed with the holes 38 having small diameter with center lines of the large holes 37 being coincident with center lines of the small holes 38 and the green sheets formed with the small holes 38 are put on the green sheet having the ground pattern layer 35. After laminated, the dielectric parts 32 machined to have circular cross sections are fitted in the large holes 37 and the lamination of the green sheets is sintered as a whole. The low temperature sintered glass ceramic substrate shrinks by the sintering and the dielectric parts 32 are buried in the substrate. The cavities 36 are formed below the dielectric parts 32 by the small diameter holes 38.

The sintering temperature of the dielectric substrate 31 is lower than a sintering temperature of the dielectric parts 32 so that the dielectric parts 32 are not influenced by the sintering of the substrate. In this embodiment, the sintering temperature of the dielectric part is in the order of 1600° C. and the sintering temperature of the low temperature sintered glass ceramic substrate is in the order of 900° C. After the sintering, predetermined areas of the substrate surface are printed with gold paste with using a printing mask to form the micro strip lines 34.

Figure 14:
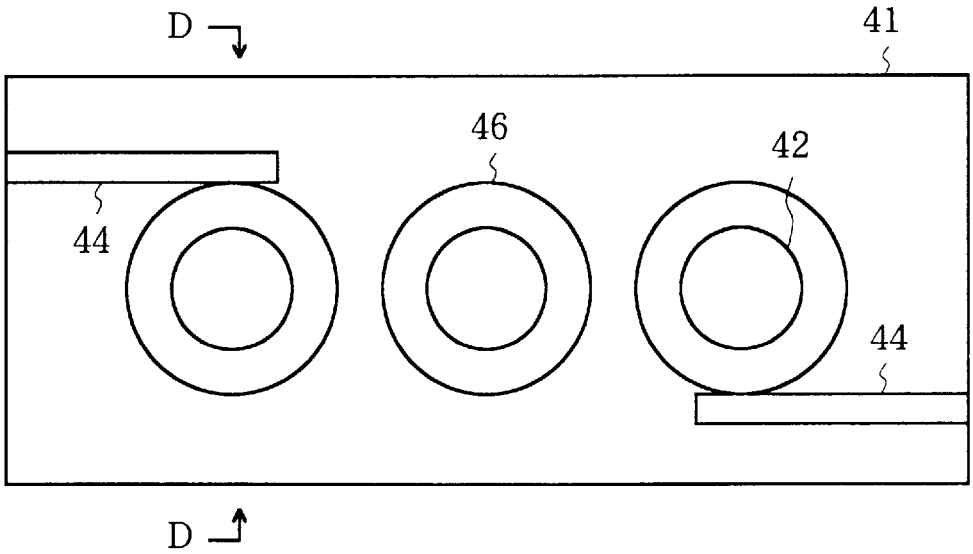
FIG. 14 is a plan view of a high frequency filter according to a fourth embodiment of the present invention.
Figure 15:
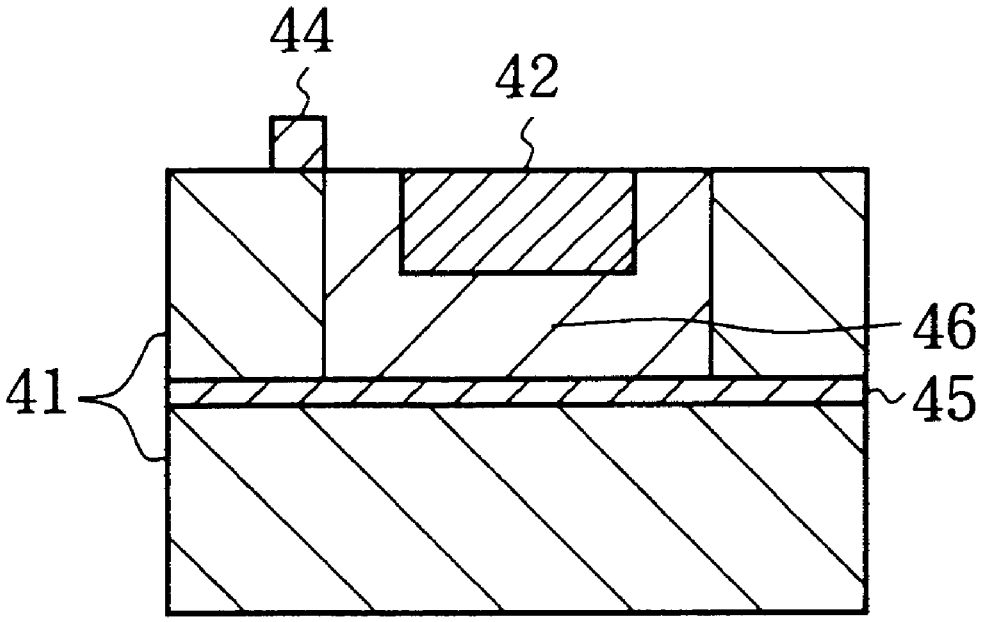
FIG. 15 is a cross section taken along a line D—D in FIG. 14.

FIGS. 14 and 15 show a high frequency filter according to a fourth embodiment of the present invention, in which FIG. 14 is a plan view of the high frequency filter and FIG. 15 is a cross section taken along a line D—D in FIG. 14. In this embodiment, three dielectric parts 42 are buried in one surface of a dielectric substrate 41 through a low dielectric constant material 46 having dielectric constant lower than that of the dielectric substrate 41. Micro strip lines 44 are provided on the one surface of the dielectric substrate 41 and a ground pattern layer 45 for the micro strip lines 44 is provided within the dielectric substrate 41. The size of the dielectric substrate 41 is about 10 mm×4 mm×2 t. Similarly to the third embodiment, the dielectric substrate has a multi-layered structure of low temperature glass ceramic. Holes for burying the dielectric parts 42 are formed in the surface of the dielectric substrate 41. The holes are formed by punching the laminated green sheets, laminating a green sheet on which the ground conductor is printed and sintering them as a whole.

In this embodiment, each dielectric part 42 except its upper surface is coated with a low dielectric constant plastic material 46 such as polytetrafluoroethylene and the dielectric parts 42 are inserted into the holes formed in the dielectric substrate 41 and fixedly secured thereto by adhesive applied to inner walls of the holes.

As the low dielectric constant material 46 coating the dielectric parts 42, Teflon group material, epoxy group material such as benzocyclobutene, polyimide group material or epoxy group material may be used instead of polytetrafluoroethylene. The thickness of the coating is preferably in the order of 0.5~1 mm with which it becomes possible to obtain higher Q value.

What is claimed is:

1. A high frequency filter comprising:

a dielectric substrate having one surface formed with conductor lines;

a plurality of holes formed in said dielectric substrate;

dielectric parts fitted in a portion of the plurality of said holes, each said dielectric part being a resonator;

magnetic parts fitted in at least a portion of the remaining holes for setting resonance frequencies of corresponding dielectric parts by magnetic fields generated by said magnetic parts, respectively.

2. A high frequency filter as claimed in claim 1, wherein said dielectric substrate is of a plastic material.

3. A high frequency filter as claimed in claim 2, wherein said plastic material is polytetrafluoroethylene.

4. A high frequency filter as claimed in claim 3, further comprising a reinforcing plate provided on the other surface of said dielectric substrate, for preventing said substrate from being mechanically deformed.

5. A high frequency filter as claimed in claim 1, wherein said dielectric substrate is of a ceramic material.

6. A high frequency filter as claimed in claim 1, wherein said magnetic part is of a hard ferrite material.

7. A high frequency filter as claimed in claim 1, wherein said magnetic parts are detachable.

8. A high frequency filter as claimed in claim 1, wherein said dielectric parts are fitted in said holes provided on said one surface of said dielectric substrate and said magnetic parts are fitted in said holes provided in the other surface of said dielectric substrate.

9. A high frequency filter as claimed in claim 8, wherein said magnetic parts and said dielectric parts are provided in mutually corresponding positions such that each said magnetic part gives a magnetic field to a corresponding one of said dielectric parts.

10. A high frequency filter as claimed in claim 8, wherein said dielectric parts are magnetically coupled with each other.

11. A high frequency filter as claimed in claim 1, wherein a cavity is formed between a lower surface of each said dielectric part and said dielectric substrate.

12. A high frequency filter as claimed in claim 1, wherein said dielectric parts are buried in said dielectric substrate through a material having dielectric constant lower than dielectric constant of said dielectric substrate.

13. A high frequency filter as claimed in claim 12, wherein said dielectric substrate is of a ceramic material and said material having dielectric constant lower than dielectric constant of said dielectric substrate is a plastic material.

14. A high frequency filter comprising:

a dielectric substrate having one surface formed with conductor lines;

dielectric parts fitted in holes formed in said dielectric substrate, each said dielectric part being a resonator; and a cavity is formed between a lower surface of each said dielectric part and said dielectric substrate.

15. A high frequency filter comprising:

a dielectric substrate having one surface formed with conductor lines; and dielectric parts fitted in holes formed in said dielectric substrate, each said dielectric part being a resonator, said dielectric parts being buried in said dielectric substrate through a material having dielectric constant lower than dielectric constant of said dielectric substrate.

* * * * *